United States Patent [19]

Jarriel et al.

[11] Patent Number: 4,974,841

[45] Date of Patent: Dec. 4, 1990

[54] ADJUSTABLE BASKETBALL GOAL ASSEMBLY

[75] Inventors: Jack B. Jarriel; James F. Kemp; William H. Ziegler, Jr., all of Opelika, Ala.

[73] Assignee: Diversified Products Corporation, Opelika, Ala.

[21] Appl. No.: 359,268

[22] Filed: May 31, 1989

[51] Int. Cl.[5] ..... A63B 63/08

[52] U.S. Cl. ..... 273/1.50 R; 211/86

[58] Field of Search ..... 273/1.5 R, 1.5 A; 211/86, 103

[56] References Cited

U.S. PATENT DOCUMENTS

| | | | |
|---|---|---|---|
| Re. 20,898 | 10/1938 | Schabinger | 273/1.5 R |
| 387,922 | 8/1888 | Schooley | 273/1.5 R X |
| 2,085,206 | 6/1937 | Holmdahl | 273/1.5 R |
| 2,192,430 | 3/1940 | Branner | 273/1.5 R X |
| 2,208,358 | 7/1940 | Chandler | 248/225.31 X |
| 2,270,796 | 1/1942 | Hauser | 211/86 |
| 2,473,908 | 6/1949 | Rubin | 273/1.5 R |
| 2,508,527 | 5/1950 | Martin et al. | 248/225.31 X |
| 2,512,417 | 6/1950 | Cook | 273/1.5 R X |
| 2,517,463 | 8/1950 | Cobb | 273/1.5 R |
| 2,889,149 | 6/1959 | Williams | 273/1.5 R X |
| 2,925,916 | 2/1960 | Pollock | 211/86 |
| 3,669,450 | 6/1972 | Mason | 273/1.5 R |
| 3,776,549 | 12/1973 | Ganis | 273/1.5 R |
| 3,814,359 | 6/1974 | Powell | 248/99 |
| 3,986,615 | 10/1976 | Robertson | 211/86 |
| 4,005,860 | 2/1977 | Ebstein et al. | 273/1.5 R |
| 4,036,494 | 7/1977 | Hayes | 273/1.5 R |
| 4,183,522 | 1/1980 | Killen | 273/1.5 R |
| 4,468,027 | 8/1984 | Pangburn | 273/1.5 R |
| 4,715,600 | 12/1987 | Offutt | 273/1.5 R |

FOREIGN PATENT DOCUMENTS

| | | | |
|---|---|---|---|
| 2383581 | 10/1978 | France | 211/86 |
| 10973 | of 1910 | United Kingdom | 211/103 |

OTHER PUBLICATIONS

Ohio Art Company, Lil' Sports-Hoops Assembly Instruction.

*Primary Examiner*—Paul E. Shapiro

*Attorney, Agent, or Firm*—Banner, Birch, McKie & Beckett

[57] ABSTRACT

A basketball goal assembly for mounting on a door frame, door, column or the like in which a support member, such as a backboard, having a hoop secured thereto is height adjustable relative to the floor. The support member, which may be a backboard, includes parallel slots formed adjacent to opposed sides thereof so that it may be frictionally slidably mounted to the door or the like by threading a strap through the slots and attaching the strap ends to the door. U-shaped brackets adapted to engage with opposed edges of a door frame, door or the like may be used to attach the strap ends to the door. A goal including basketball hoop is pivotally secured to the support member or backboard. The installed goal assembly permits friction restrained movement of the hoop to any number of vertical positions along the mounting surface, while frictionally maintaining the hoop in a fixed vertical position during normal use.

21 Claims, 4 Drawing Sheets

ADJUSTABLE BASKETBALL GOAL ASSEMBLY

FIELD OF THE INVENTION

The invention relates to a basketball goal asembly for mounting on a wall, door, door frame, column or the like and more particularly relates to a basketball goal assembly which is slidably mounted on a vertical surface so as to be adjustable in height with respect to the floor.

BACKGROUND OF THE INVENTION

Heretofore, basketball goal apparatus have included brackets or the like which permit a basketball goal to be mounted on a flat surface such as a wall or door. See, for example, U.S. Pat. No 4,715,600 to Offutt, where the door-mounted goal assembly includes brackets generally having a U-shaped channel to facilitate attaching the bracket over the upper and lower edge of the door. When the door is closed, the door jamb above the door further helps retain the upper bracket in position.

Furthermore, a height adjustable basketball goal assembly has been disclosed by Offutt in U.S. Pat. No. 4,715,600. The height adjustable goal permits people of varying age and size to play the game. For example, variably adjusting the height of the basketball goal on a vertical surface, such as a door, enables younger children, as well as adults, to play the game using the same goal.

However, present adjustable backboards have exhibited certain drawbacks. First, the backboard usually is adjustably mounted on a rigid support pole made up from a plurality of members. The number of component parts gives rise to a number of assembly or disassembly steps when preparing the apparatus for use or storage. Furthermore, various components of the multiple component adjustabl goal support member may be lost when the apparatus is being placed into or returned from storage. Secondly, before readjusting the backboard height, it is necassary to remove fasteners which secure the backboard to the support pole. Then the fasteners are resecured after the backboard has been raised or lowered by a predetermined interval and realigned.

SUMMARY OF THE INVENTION

It is therfore an object of the present invention to provide a baseketball goal assembly, including a support member and goal, which may be slidably secured to a mount having a vertical surface, such as a wall, door frame, door, column or the like, thereby enabling the goal height to be vertically adjusted above the floor.

It is another object of the present invention to provide a basketball goal assembly with a flexible securing mechanism, which slidably and frictionally secures the backboard and goal on the vertical surface and supports the same at a desired position above the floor.

It is still another object of the invention to provide a goal assembly with a mounting mechanism which may be folded upon itself, thereby enabling the basketball goal assembly to be stored in a small space without disassembling the mounting mechanism, backboard and goal for storage.

It is a further object of the present invention to provide a basketball goal assembly with a mounting mechanism which enables the height of the goal assembly to be adjusted along the vertical surface of a mount without disassembling any components of the goal assembly.

It is yet another object of the present invention to provide a basketball goal assesmbly with a mounting mechanism that allows the backboard or goal assembly to be positioned at an infinite number of positions above the floor.

It is yet a further object of the present invention to provide a basketball goal assembly wherein the normally horizontally positioned goal hoop is pivotally secured to a support member, such as a backboard, so that the hoop may be compactly positioned substasntially parallel to the support surface and close thereto, when the assembly is not in use.

These and other objects of the invention are achieved in a basketball game goal assembly frictionally mountable before a substantially vertical surface. The assesmbly includes a normally horizontally disposed hoop and a mounting mechanism for frictionally positioning the hoop at a location on the vertical surface. The mounting mechanism also permits friction restrained movement of the hoop to other vertical positions, while frictionally maintaining the hoop in a fixed position during normal use.

In a preferred embodiment, the hoop is secured to a backboard having slots formed therein. A strap, or the like, extends through the slots formed in the backboard. When the strap is attached to a vertically disposed mount having a vertical surface, such as a wall, door frame, door, column or the like, the backboard and hoop are then slidable along the strap, and therefore are slidable along the vertical surface of the mount. The friction between the strap and the portion of the backboard which the strap contacts when extended through the slots, is sufficient to maintain the goal assembly in a fixed vertical position while permitting friction restrained movement of the goal assembly to other vertical positions.

Further objects, features and other aspects of the invention will be understood from the following description of a preferred embodiment of the invention referring to the attached drawings.

DETAILED DESCRIPTION OF THE PREFERRED EMBODIMENT

Figure 1:
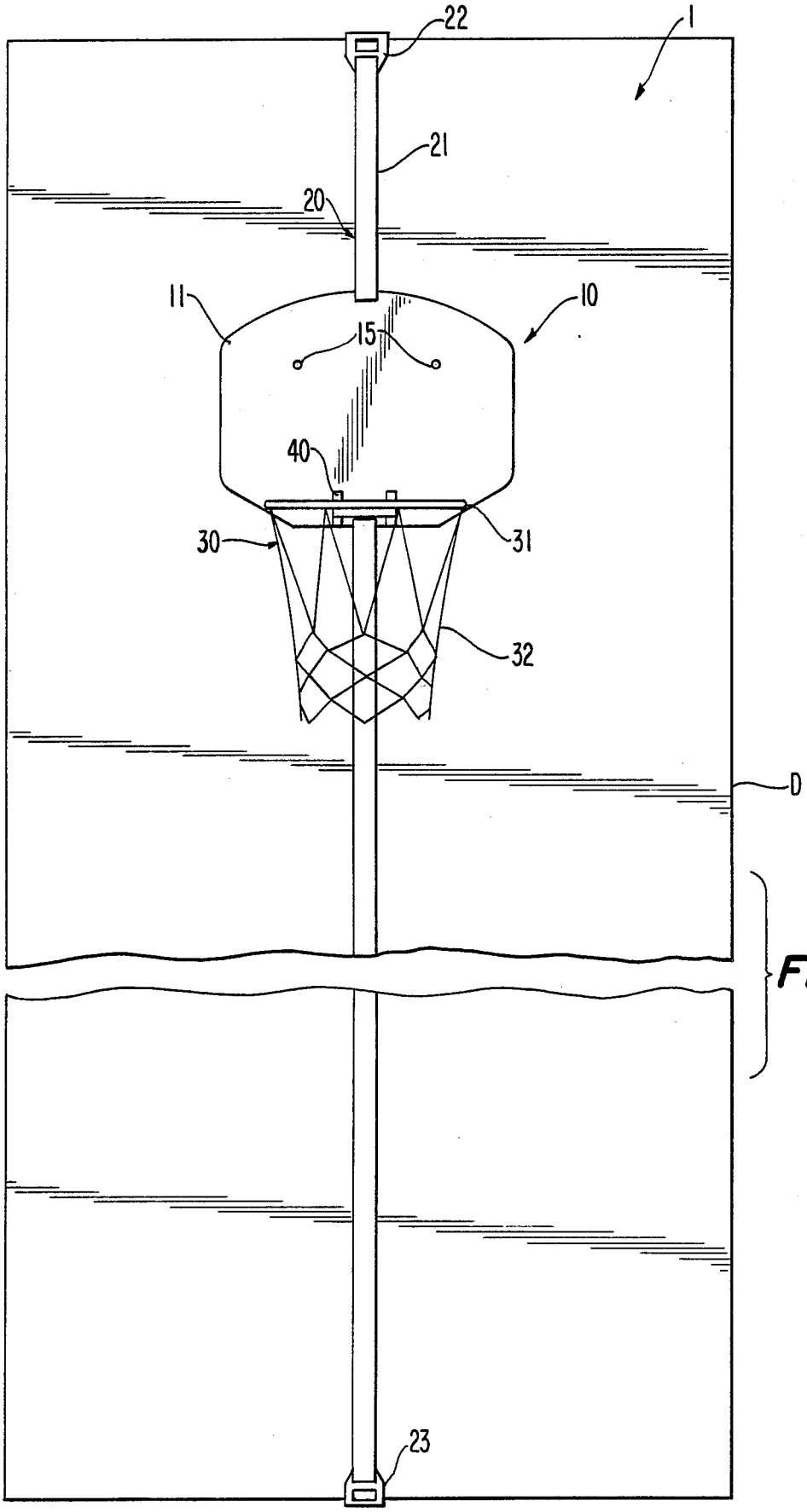
FIG. 1 is a front elevational view of a preferred embodiment of the basketball goal assembly attached to a mount, such as a conventional door.

Referring to the drawings in detail, wherein like numerals indicate like elements, FIG. 1 shows a basketball goal assembly 1, secured to mounting surface D, according to a preferred embodiment of the present invention. Mounting surface D may be associated with any substantially vertically disposed structure, i.e., a mount, such as a wall, door, door frame, or the like. As will be discussed below, the mount also may comprise a substantially vertically disposed column or the like.

Basketball goal assembly 1 includes goal 30, comprising hoop member 31 and basket-like netting 32, pivotally mounted to backboard 11 of basketball backboard assembly 10 through backboard hoop mounting bracket 40. Basketball backboard assembly 10 and goal 30 are slidably and frictionally mounted on the vertical surface of a mount through strap assembly 20 having flexible strap 21 which passes through slots formed in the backboard. Strap assembly 20 further includes upper bracket 22 and lower bracket 23 for attaching strap 21 of strap assembly 20 to spaced upper and lower portions of the verical mounting surface.

Figure 2A:
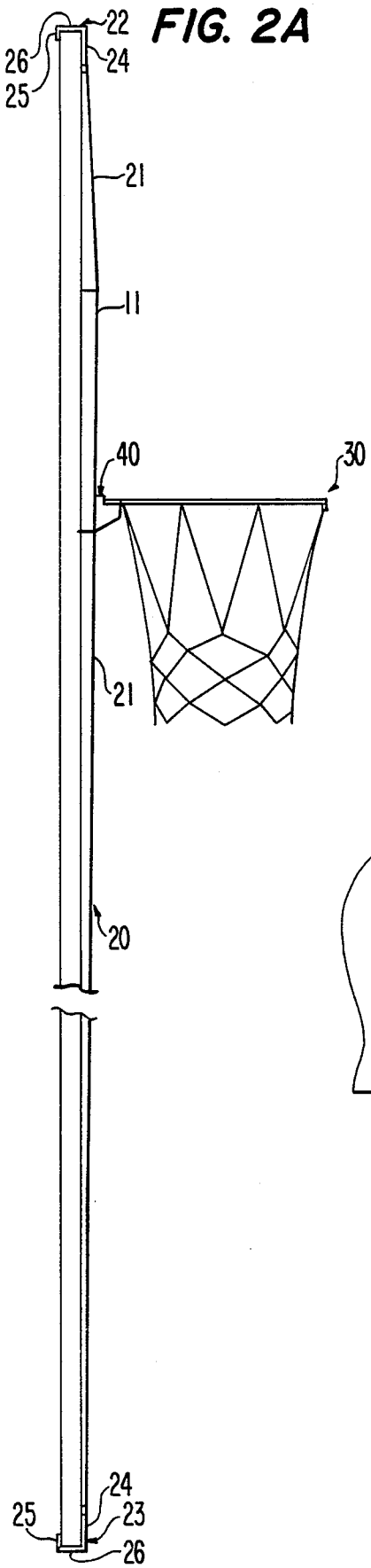
FIG. 2A is a side elevational view of the basketball goal assembly depicted in FIG. 1.
Figure 2B:
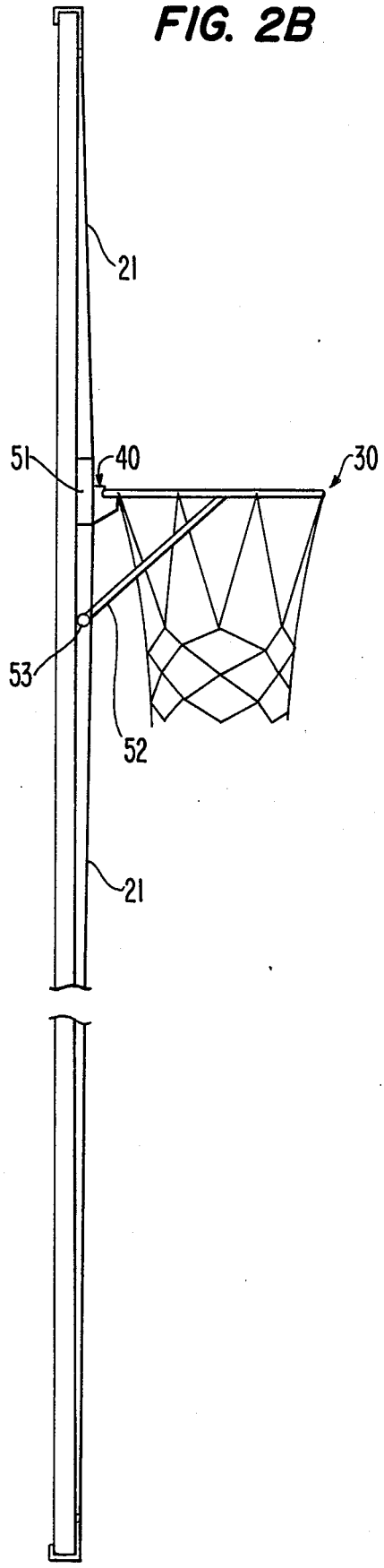
FIG. 2B is a side elevational view of a further embodiment of the basketball goal assembly of FIG. 1.

When mounting surface D is a door surface, as shown in FIGS. 2A and 2B, brackets 22 and 23 are preferably generally U-shaped in configuration. Brackets 22 and 23, for example, may be molded to form a relatively thin piece of plastic having a thickness for permitting the door to close with upper bracket 22 between the upper edge of the door and the lower edge of the door jamb (not shown). Each bracket includes bracket legs 24 and 25 which extend from web 26. Web 26 has a flat inside surface for seating against an edge of the door. To further secure the connection between the brackets and doors of various thicknesses, bracket legs 24 and 25 may be formed so as to be slightly bent toward each other. For example, each inner leg surface may form an acute angle with web 26. The bend or convergent leg configuration spring biases the legs against the door upon installation.

Each bracket leg 24 is provided with three parallel slots. During assembly, one end of strap 21 is threaded through all three slots of upper bracket leg 24. The other end of strap 21 is threaded through two slots only of lower bracket leg 24. After brackets 22 and 23 have been pushed over opposed ends of a door, the strap tension is adjusted by simultaneously pulling down on the main or central portion of strap 21, between brackets 22 and 23, and pulling up on the free other end of strap 21 which has been threaded through two slots of lower bracket 23.

Figure 3:
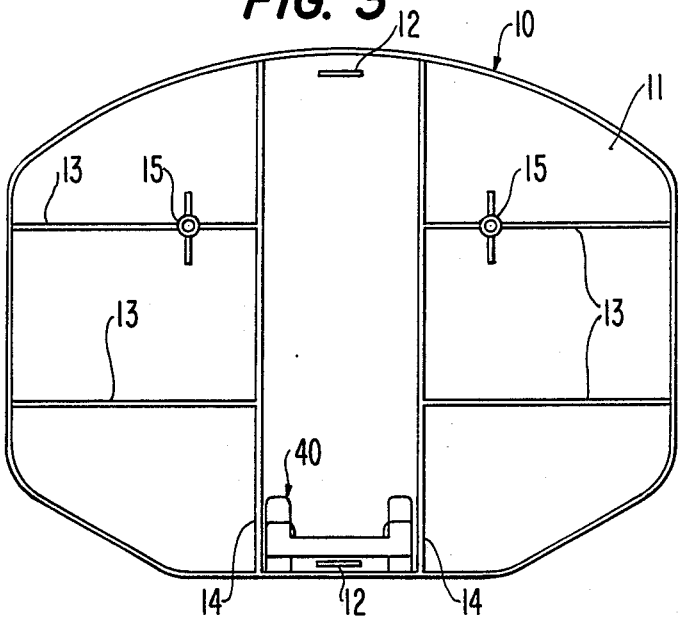
FIG. 3 is a rear elevational view of the basketball backboard assembly of FIG. 1.

Referring to FIGS. 1 and 3, backboard 11 includes parallel slots 12 for receiving flexible strap 21. When strap 21 is extended through slots 12, prior to securing the brackets to the ends thereof, and then secured to the door by brackets 22 and 23, the vertical height of backboard 11 and goal 30 may be adjusted by merely sliding backboard 11 in either direction along the length of strap 21.

It is well settled that the coefficient of friction (u), between two surfaces is the ratio of the force (F) required to move one surface over the other surface to the total force (W) pressing the two together as represented by the equation which appears below.

$$u = F/W$$

Therefore, the static friction along the mating surfaces of the strap and that portion of the backboard which the strap contacts when extended through the slots, is sufficient to maintain the goal assembly in a fixed vertical position. However, when a force is applied to the goal assembly which exceeds the product of the static coefficient of friction between those two surfaces and the force pressing those two surfaces together, the goal assembly may be moved subject to the kinetic coefficient of friction between those two surfaces. Consequently, the friction between the strap and backboard also permits friction restrained movement of the goal assembly of other vertical positions.

Referring to FIG. 3, backboard assembly 10 includes backboard 11, slots 12 at the upper and lower portion of backboard 11 for receiving strap 21 and backboard hoop mounting bracket 40 for receiving goal 30 and pivotally securing the goal to the backboard. As shown in FIG. 3, the rear of backboard 11 is recesssed and strengthened by horizontal and vertical stiffeners 13 and 14, respectively. Two countersunk holes 15 are provided in backboard 11.

It should be understood that backboard 11 which functions as a support member for the strap and hoop, as well as a rebounding surface for the game ball, may be modified without departing from the scope of the invention. For example, when mounting the goal on a planar surface, the planar surface can function as a basketball rebounding surface, i.e., a backboard, thereby eliminating the need to use the backboard configuration of backboard 11. Consequently, backboard 11 may be replaced by any suitable support member, which may or may not have a planar surface, but which has strap receiving slots formed therein for frictionally and slidably mounting the support member on a vertical surface of a mount. The hoop, being secured to such a support member, also would be slidably mounted on the mounting surface so that the distance between the hoop and the floor could readily be adjusted. Merely to illustrate one of the many possible support member designs, reference will be made to FIG. 2B. In FIG. 2B, substantially planar support member 51 is shown as extending from immediately above the hoop to below the hoop. The extend to which the support member extends below the hoop may vary. In FIG. 2B support member 51 is shown as extending only a short distance below the hoop. Whatever the case may be, it may be necessary to counter the moment developed by the hoop extending from the support member. Therefore, a brace may be included to counter such a moment. The brace may extend from a point on the hoop spaced from the support member, to the lower portion of the support member, or to the planar surface of the mount below the hoop. Referring to FIG. 2B, a pair of braces 52, of which one is hidden in this view, extend from the hoop to the mounting surface. Sliding elements 53, such as rollers, may be provided on braces 52 to prevent damage to the mounting surface when the goal assembly is moved up or down the surface along the strap. Sliding elements 53 also minimize drag between braces 52 and the mounting surface when the goal assembly is vertically adjusted. In yet a further embodiment, a substantially planar support member which extends minimally above the hoop may be provided with more than one pair of slots wherein each pair would receive a respective strap.

It also will be apparent that brackets 22 and 23 may be replaced by other devices for attaching the strap to the mounting surface without departing from the scope of the invention. Merely to provide a sampling of possible attachment mechanisms the following examples may be recited. End portions of the strap may be fixed to the front surface of the mount with suitable fastener mechanisms. A strap length adjusting device to tighten the strap could be incorporated into a respective one of the fastener mechanisms, or along the central or main portion of the strap. On the other hand, the strap may extend around the front and back surface of the mount so that the strap end portions may be secured to one another. Again, a strap length adjusting device could be associated with the strap at any desired position.

The strap-slot combination provides a friction connection between the support member and strap. Therefore, the strap-slot mechansism, once mounted on the vertical surface, permits continuous positioning of the hoop along the strap by merely sliding the hoop or support member along the strap, i.e., without other adjustments to the goal assembly after installation. This combination also permits the hoop to be positioned at an infinite number of positions above the floor. However, other friction mechanisms may be used to achieve this function without departing from the scope of the invention. For example, when mounting the backboard and hoop to a column-like mount, such as a pole, the strap may be replaced by a slide member slidably mounted on the pole, wherein the slide member includes a mounting mechanism which permits friction restrained movement of the slide member along the columnn or pole to various vertical positions, while frictionally maintaining the hoop in a fixed vertical position during normal use, such as a bushing.

Figure 7:
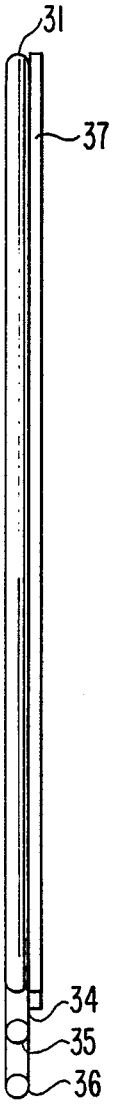
FIG. 7 is a side elevational view of the basketball hoop member.
Figure 8:
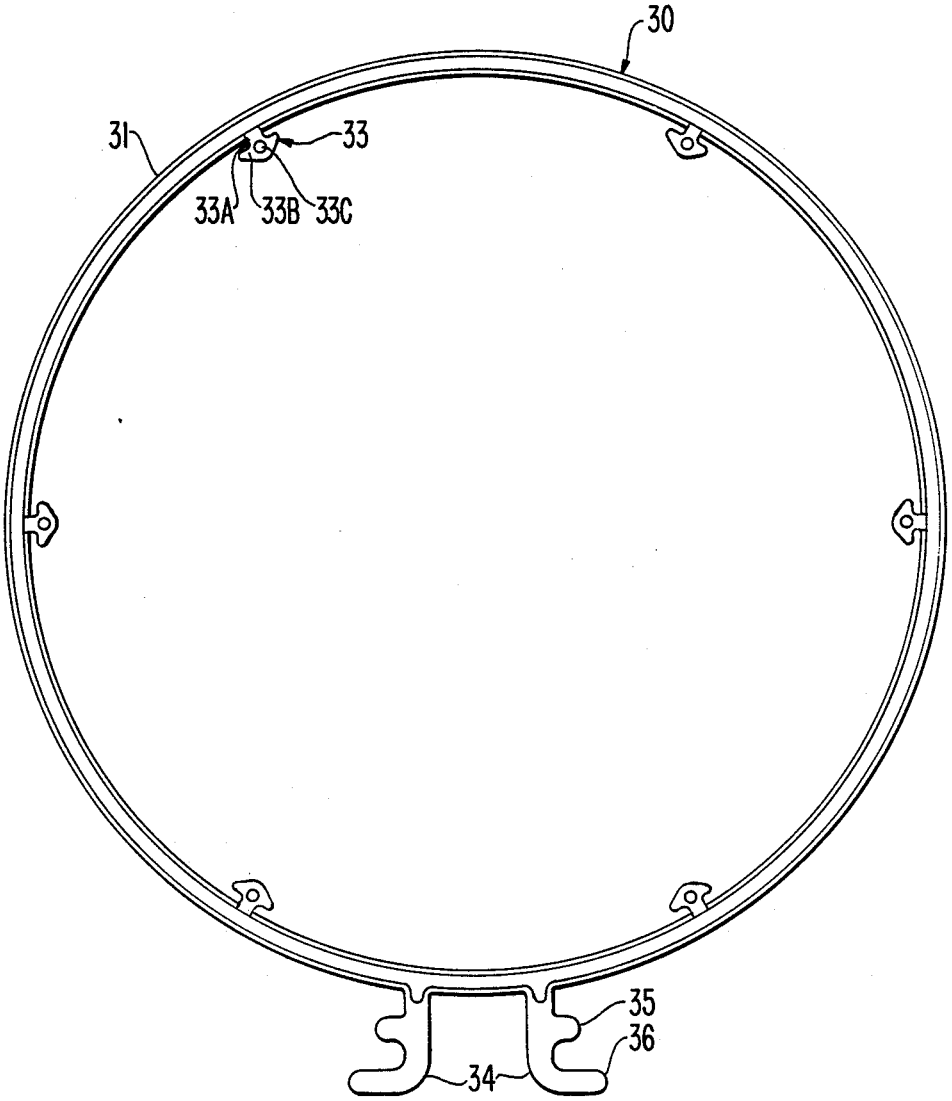
FIG. 8 is a top plan view of the basketball hoop member.

Referring to FIGS. 7 and 8, circular hoop member 31 includes circular raised rib 37 with generally arrow-shaped netting hangers 33 projecting radially inwardly from the juncture between hoop 31 and rib 37. Hangers 33 include straight portions 33A terminating in arrowhead portions 33B which have holes 33C. Basket-like netting 32 (see FIGS. 1 and 2) is suspended from hangers 33, by inserting an upper string of the netting as a loop through hole 33C, wrapping the loop around arrowhead portion 33B and pulling the netting downwardly until the loop around arrowhead portion 33B is snug. Hoop 31 further includes hoop support arms 34 projecting outwardly therefrom for pivotally mounting hoop 31 to hoop mounting bracket 40. Extending from each arm 34 is locking branch 35 and pivot branch 36.

Figure 4:
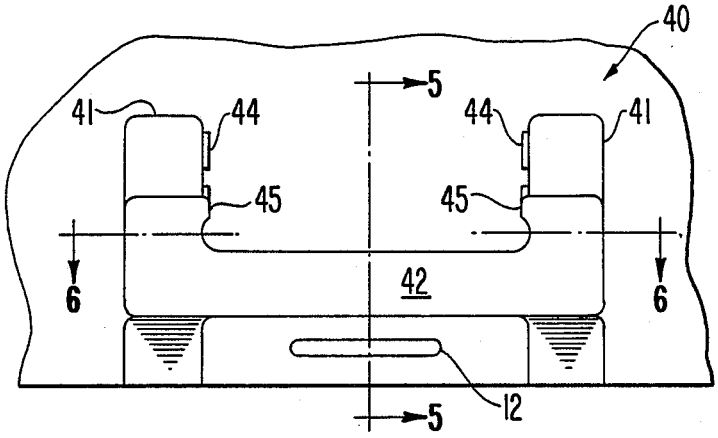
FIG. 4 is a front elevational view of the basketball hoop mounting bracket formed at the base of the basketball backboard of a preferred embodiment.
Figure 5:
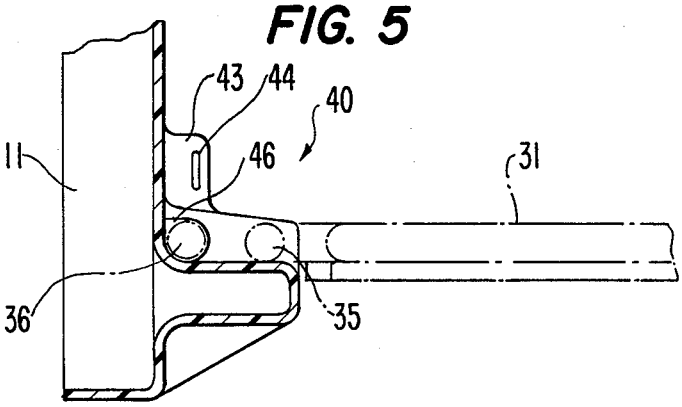
FIG. 5 is cross-sectional view of the basketball hoop mounting bracket taken along line 5—5 of FIG. 4 depicting a portion of the hoop member in phantom.
Figure 6:
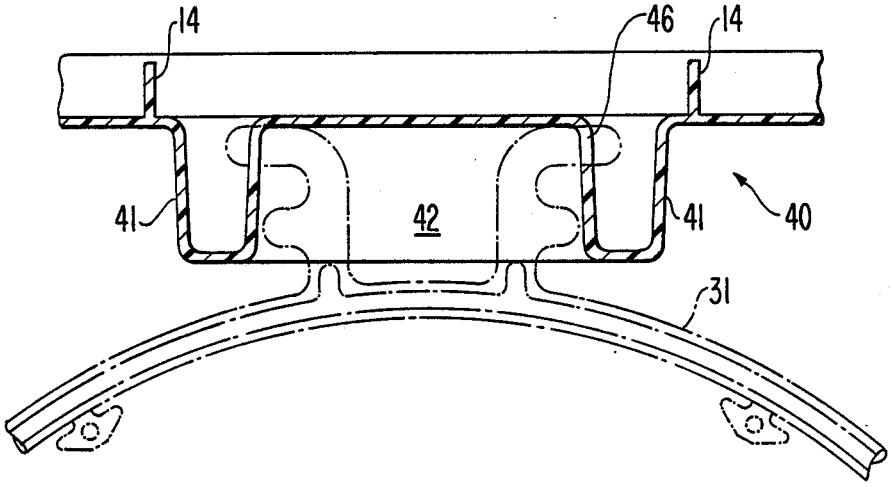
FIG. 6 is a cross-sectional view of the basketball hoop mounting bracket taken along line 6—6 of FIG. 4 depicting a portion of the hoop member in phantom.

As shown in FIGS. 4–6, H-shaped mounting bracket 40 generally comprises parallel vertical sections 41 and horizontal connecting portion 42. Generally, rectangular connecting portion 42 connects vertical sections 41 and sufficiently extends from backboard 11 to form a substantially flat support surface for hoop support arms 34. Pivot hole 46, which receive pivot branches 36, are positioned where vertical sections 41 merge with backboard 11 and the upper surface of connecting portion 42. The diameters of holes 46 are greater than the diameters of pivot branches 36. Therefore, hoop 31 may be pivoted relative to mounting bracket 40 and backboard 11 after inserting pivot branches 36 into pivot holes 46. Detents 44 are provided on inner surfaces 43 of vertical sections 41 while inner curved portions of vertical sections 41, adjacent the outermost surface of connecting portion 42, relative to backboard 11, form detents 45. It should be noted that other suitable detent designs may be used without departing from the spirit of the invention.

When hoop member 31 is pivoted to a vertical position substantially parallel to backboard 11, locking branches 35 engage detents 44 and hoop 31 becomes releasably locked in the vertical position. After hoop 31 has been locked in the vertical position, the basketball game assembly becomes more suitable for storage due to the compact configuaration achieved in this position. It should be further noted that positioning the hoop vertically also avoids excessive contact between the hoop and the wall adjacent to the door, to which the goal assembly is attached, when the door is opened. When hoop member 31 is pivoted to a horizontal position substantially normal to backboard 11, locking branches 35 engage detents 45 and hoop 31 becomes releasably locked in the horizontal playing position. Furthermore, detents 45 prevent excessive hoop vibration and hoop displacement when a ball contacts the hoop while playing the game.

Door mounted goal assemblies, including a backboard, hoop and U-shaped strap to door attaching brackets, preferably are made from high density polyethylene, when the goal assemblies are intended to be used with light basketballs. Furthermore, in this instance, backboard assembly 10 and hoop mounting bracket 40 preferably are formed from a single mole. However, such material and manufacturing descriptions are made only by way of example and not as limitations to the scope of the invention. For example, the above described mounting mechanisms for slibably mounting the hoop to a vertical surface may be used with conventional goals, or conventional backboard and goal combinations. Consequently, the materials would be selected so as to be more durable for such use, as opposed to the aforementioned plastic, which is particularly suitable for miniature versions of the basketball goal assemblies.

Although an illustrative embodiment of he invention has been described in detail with respect to the accompanying drawings, it is to be understood that the invention is not limited to that precise embodiment, and that various changes and modifications may be effected therein by one skilled in the art without departing from the scope of the invention.

We claim:

1. A basketball goal assembly suitable for attachment to a mount having a substantially vertically disposed surface, said apparatus comprising:

as backboard having a substantially flat surface and slots formed therein for receiving a strap, said slots being disposed in parallel and adjacent to opposed sides of said backboard;

a goal including a hoop, said hoop being pivotally secured to said backboard; and a strap extending through said slots so that said hoop and backboard are slidable in either direction along said strap, said strap having a first and second end portion, each end portion including an attachment device adapted for attaching the strap to the mount.

2. A basketball goal assembly mountable before a substantially vertical surface, the assembly comprising:

a normally horizontally disposed hoop; and mounting means for frictionally positioning the hoop at a location on the vertical surface, said mounting means comprising a support member having slot means formed therein and disposed adjacent opposed sides thereof for receiving at least one strap, said hoop being secured to said support member, and said mounting means permitting friction restrained movement of the hoop of to other vertical positions, while frictionally maintaining the hoop in a fixed vertical position during normal use.

3. The assembly of claim 2 wherein said slot means includes parallel slots.

4. The assembly of claim 3 wherein said hoop mounting means further comprises at least one strap threaded through said slot means so that said support member may slide in either direction along said at least one strap.

5. The assembly of claim 4 wherein said slot means includes parallel slots.

6. The assembly of claim 5 wherein said at least one strap includes attaching means for releasably attaching said strap to said substantially vertical surface.

7. The assembly of claim 4 wherein said at least one strap includes attaching means for releasably attaching said strap to said substantially vertical surface.

8. The assembly of claim 7 wherein said at least one strap includes first and second end portions, and said attaching means comprises a U-shaped bracket associated with each strap end portion.

9. The assembly of claim 8 wherein said support member includes a backboard and hoop securing means for pivotally securing said hoop to said backboard.

10. The assembly of claim 7 wherein said support member includes a backboard and hoop securing means for pivotally securing said hoop to said backboard.

11. The assembly of claim 4 wherein said support member is a backboard.

12. The assembly of claim 11 wherein said slot means includes parallel slots.

13. The assembly of claim 12 wherein said at least one strap includes attaching means for releasably attaching said strap to said substantially vertical surface.

14. The assembly of claim 13 wherein said support member includes hoop securing means for pivotally securing said hoop to said backboard.

15. The assembly of claim 14 wherein said at least one strap includes first and second end portions, and said attaching means comprises a U-shaped bracket associated with each strap end portion.

16. The assembly of claim 2 wherein said support member is a backboard.

17. The assembly of claim 2 wherein said support member includes hoop securing means for pivotally securing said hoop to said support member.

18. The assembly of claim 17 wherein said hoop comprises two hoop support arms radially extending from said hoop, each support arm having a pivot branch pivotally associated with said hoop securing means and a locking branch for releasably locking said hoop in a fixed orientation relative to said support member.

19. The assembly of claim 18 wherein said hoop securing means comprises an H-shaped bracket having two parallel sections and a connecting portion therebetween, each parallel section being provided with first detent means for engaging said hoop and releasably securing said hoop in a first positoin substantially parallel to said support member, each parallel section further being provided with second detent means for engaging said locking branch and releasably securing said hoop in a second position substantially normal to said support member.

20. The assembly of claim 19 wherein said connecting portion extends from said support member and forms a surface for said hoop support arms.

21. The assembly of claim 2 further comprising a basket-like net suspended from said hoop.

* * * * *